US005288260A

United States Patent [19]

Chen et al.

[11] Patent Number: 5,288,260

[45] Date of Patent: Feb. 22, 1994

[54] OPTICAL FUN DEVICE

[76] Inventors: Haw-Renn Chen; Feichu H. Chen, both of 4057 Little Hollow Pl., Moorpark, Calif. 93021

[21] Appl. No.: 945,898

[22] Filed: Sep. 17, 1992

[51] Int. Cl.[5] ..... A63H 1/22

[52] U.S. Cl. ..... 446/243; 446/256; 359/616

[58] Field of Search ..... 446/243, 246, 255, 256; 359/616

[56] References Cited

U.S. PATENT DOCUMENTS

| | | | |
|---|---|---|---|
| 2,018,537 | 10/1935 | Savage | 446/236 |
| 3,128,569 | 4/1964 | Eberhart | 446/243 |
| 3,272,506 | 9/1966 | Lescher | 446/243 |
| 3,366,786 | 1/1968 | Delano | 359/616 |
| 3,711,697 | 1/1973 | Boyle | 359/616 |
| 4,002,401 | 1/1977 | Malberg | 359/616 |
| 4,815,801 | 3/1989 | Anderson | 359/616 |
| 5,009,471 | 4/1991 | Lee | 359/616 |

FOREIGN PATENT DOCUMENTS

| | | | |
|---|---|---|---|
| 2735981 | 2/1979 | Fed. Rep. of Germany | 446/243 |
| 2518258 | 6/1983 | France | 446/243 |
| 0666803 | 2/1952 | United Kingdom | 446/243 |
| 1536607 | 12/1978 | United Kingdom | 446/243 |

*Primary Examiner*—Robert A. Hafer
*Assistant Examiner*—Gregory M. Stone

[57] ABSTRACT

A color variation device for educational and/or entertainment purposes has a color mixing unit which comprises a number of color variation components.. The color mixing unit can be set in motion by a motion manipulation unit while each color variation component contains a mechanism that can make the color on the visible surface of the color variation components be changible by the players. The color variation components are suggested to be configured with triangular pyramidal shape that are radially placed around the horizontal center of a circular color mixing unit sequentially in the direction of the color mixing unit motion. Different combination of colors selected on each color variation component on the color mixing unit can generate different colors when the color mixing unit is set in motion by the motion manipulation unit. The more color variation components are placed on the color mixing unit, the more variation of color can be generated by selecting the displaying color on each of the color variation components.

10 Claims, 1 Drawing Sheet

OPTICAL FUN DEVICE

This invention relates in general to educational and/or entertaining apparatus and more particularly concerns a novel optical device in which displaying color can be varied by varying the combination of the color components imbedded on the apparatus.

The invention is simple in operation and is interesting to attract players' curiosity. Also, the invention is joyable to operate while the amusing optical phenomenon associated with the operation can satisfy the players' unlimited curiosity and helps players to recognize the nature of light.

Since the invention can help players to learn the essence of color and composition of light by playing the novel optifun device, the invention provides a means that can enhance the roles of a toy to contain the educational function and, consequently, makes learning process be a part of a fun play.

Furthermore, the invention can be utilized as a tool to enhance the creativity of players. According to the invention, the players engaging in playing the optifun device can put together a set of color components to verify what the composed color will be. Also, the players can select a composed color and pick those color elements that they think will be the component colors which can be mixed to generate the selected composed color. Imagination is greatly involved in the process and hence the creativity.

Numerous other features, objects and advantages of the invention will become apparent from the following specification when read in connection with the accompanying drawing in which.

Figure 1:
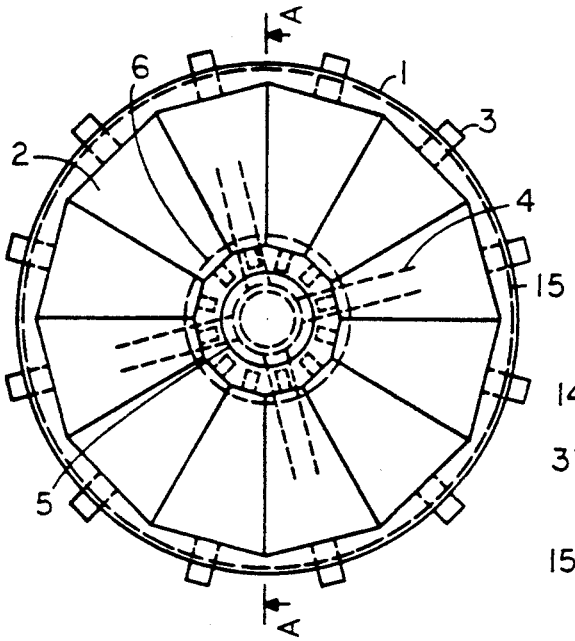
FIG. 1 illustrates the cross-sectional top view of an optifun device.
Figure 2:
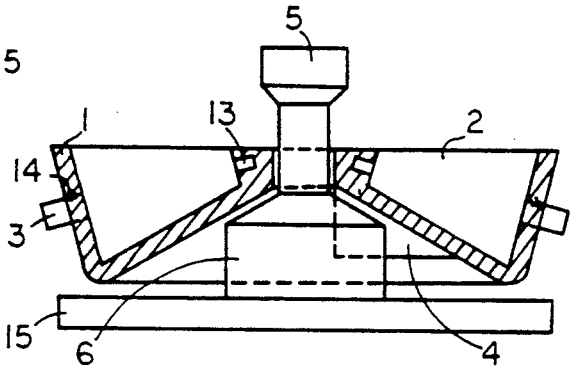
FIG. 2 illustrates the cross-sectional side view of the optifun device along plane AA in FIG. 1.

With reference now to the drawing, FIG. 1 shows a horizontal sectional diagrammatic representation of an optifun device while FIG. 2 shows a vertical sectional diagrammatic representation along plane AA in FIG. 1. As illustrated in FIGS. 1 and 2, a reasonable number of color variation means 2 are placed over the color mixing means 1 around the motion manipulation means 5 and 6 radially. The color mixing means 1 sitting over the motion manipulation means 6 through the fin-like extrusions 4 is to be set in motion in any predetermined manner, preferably in horizontal rotation, driven and controlled by the motion manipulation means 5 and 6. The motion manipulation means 5 and 6 are supported by supporting means 15.

The fin-like extrusions 4 are extended parts of the color mixing means 1 extruding downwardly and radially from the inner lower portion of the color mixing means and sitting on the motion manipulation means 6. To have the color mixing means 1 balanced on the motion manipulation means 6, the fin-like extrusions 4 are equally spaced around the motion manipulation means 6. As depicted in the example of FIG. 1, there are four fin-like means 4 separated from each other by 90 degrees.

Figure 3:
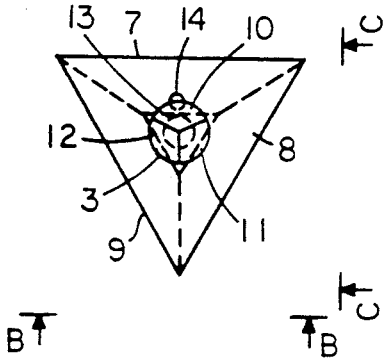
FIG. 3 illustrates one of the side view of a color variation means.
Figure 4:
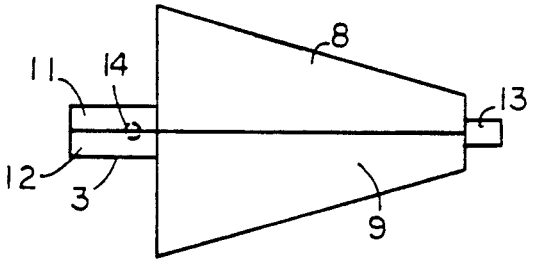
FIG. 4 illustrates the side view of the color variation means along plane BB as illustrated in FIG. 3.
Figure 5:
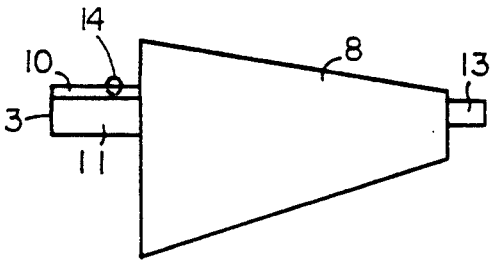
FIG. 5 illustrates the side view of the color variation means along plane CC as illustrated in FIG. 3.

The color variation means 2 can be made with any appropriate shape and mechanism to have the surface color be changible among a predetermined color set. A preferred arrangement of the color variation means 2 is illustrated in FIGS. 3, 4 and 5 in which the color variation means 2 is configured with triangular pyramid shape. A color adjusting means 3 is at the wider end of the triangular pyramid to be utilized for selecting the color by axially turning the color variation means 2. An orientation fixing means 14 preferably a deformable small flexible sphere, can be added to each color adjusting means 3 as a means to hold the selected orientation of the color variation means 2 so that, once the orientation of the color variation means 2 has been set, the color variation means 2 won't vary it's orientation by rotating around its axis on the color mixing means 1 even if the color mixing means 1 is in motion. A supporting means 13 coaxial to the color adjusting means 3 is at the narrower end of the triangular pyramid for supporting the triangular pyramidal color variation means 2 at a fixed place. The three triangular pyramid surfaces of the color variation means 2 are denoted by 7, 8, and 9 in FIG. 3 which illustrates the side view perpendicular to the axis of the triangular pyramid. FIG. 4 shows the side view of the color variation means 2 along plane BB in FIG. 3. FIG. 5 shows the side view of the color variation means 2 along plane CC in FIG. 3.

As illustrated in FIG. 3, the color variation means has equilateral triangle cross section with the three side surfaces 7, 8, and 9 having the same size and shape. The end surface and the side surface of the color adjusting means 3 are subdivided into three sections 10, 11, and 12 to contain colors matching to the color on surfaces 7, 8, and 9 respectively. Sections 10, 11, and 12 are to assist players to locate the expected color on any side of the color variation means 2 since two sides of the color variation means 2 would be hidden when the color variation means 2 are placed side by side on the color mixing means 1 as illustrated in FIG. 1.

Each side of the triangular pyramidal color variation means 2 can contain one or more colors. The colors can be created by emissive sources, which contains one or more light sources such as flourescence substances in the color variation means 2, or by reflecting incoming light at the surface or at some substance within the color variation means 2. A Kaleidoscope type of mechanism can also be added to have special color effects. Since all the visible colors are composed of three primary color elements 'red', 'green', and 'blue', the primary color elements are the preferred colors to be used on each side of the triangular pyramidal color variation means 2. 'White' and 'black' are also preferred colors to be added to the color sets on the color variation means 2. In addition, the color variation means 2 can be removable such that the color sets can be changed or expanded by changing the color variation means 2 having different color sets.

When in operation, the players can turn the color adjusting means 3 of each of the color variation means 2 to let the surface side with desired color face up. After all the desired colors over each of the color variation means 2 have been selected to face upwards, the players can rotate the color mixing means 1 horizontally through the motion manipulation means 5 and 6. By rotating the color mixing means 1 horizontally, all the colors selected on each color variation means 2 will be mixed, due to persistence of vision, to reflect a specific composed color. For example, the specific composed color will be 'white' if there are same numbers of 'red', 'green', and 'blue'. Since the color variation means 2 can be set to have any combination of 'red', 'green', 'blue', or other color sets, a great deal of various colors can be created or generated.

Although the above detail description contains many specifications, these should not be construed as limiting the scope of the invention but as merely providing illustrations of some of the presently preferred embodiments of this invention. For example, the shape of the color variation means is not limited to the triangular pyramid; the mechanism for varying the color on the color variation means can be other mechanical or electrically optical types; the motion of the color mixing means can be linear or vertical rotational motion; and so forth. Thus the scope of the invention should be determined by the appended claims and their legal equivalents, rather than by the examples given.

What is claimed is:

1. An optifun device comprising color mixing means being able to be set in motion at a predetermined way, motion manipulation means for manipulating the motion of said color mixing means, and more than one color variation means placed on said color mixing means in sequence along the direction of the motion of said color mixing means, each of said color variation means being a solid with colored surfaces placed on said color mixing means in a manner that only a portion of said colored surfaces, selected at any time, and the color thereon can be set to be visible on said color mixing means such that a specific color set composed of each individual selected surface portion and the color thereon of every of said color variation means set to be visible respectively on said color mixing means is visible therefore, by setting said color mixing means in motion, said color variation means move along sequencially in said direction of said motion of said color mixing means to have color pattern or coloring based on said specific color set visibly formed thereon.

2. An optifun device as set forth in claim 1 wherein said color variation means is configured to be triangularly pyramidal.

3. An optifun device as set forth in claim 1 wherein said color variation means, being triangularly pyramidally shaped, has each side surface preset with one or more colors.

4. An optifun device as set forth in claim 1 wherein said color variation means contains color elements of red, green, and blue.

5. An optifun device as set forth in claim 1 wherein said color variation means contains color element of white and/or black.

6. An optifun device as set forth in claim 1 wherein said color mixing means can be set in rotational motion.

7. An optifun device as set forth in claim 1 wherein said color variation means has color set generated by emissive sources therein.

8. An optifun device as set forth in claim 1 wherein said color variation means has color set generated by reflecting incoming light at the surface thereof.

9. An optifun device as set forth in claim 1 wherein said color variation means has color set generated by reflecting incoming light at substance therein.

10. An optifun device as set forth in claim 1 wherein said color variation means has Kaleidoscope mechanism for generating special color effect.

* * * * *